US006527618B1

(12) United States Patent
Faunda et al.

(10) Patent No.: US 6,527,618 B1
(45) Date of Patent: Mar. 4, 2003

(54) DOLL HEAD WITH AN ATTACHABLE DOLL WIG AND METHOD OF MAKING THE SAME

(76) Inventors: Andrew P. Faunda, 935 Paulin Rd., Poland, OH (US) 44514; Paula S. Farcas, 52 Country Green Dr., Austintown, OH (US) 44515

( * ) Notice: Subject to any disclaimer, the term of this patent is extended or adjusted under 35 U.S.C. 154(b) by 212 days.

(21) Appl. No.: 09/676,960

(22) Filed: Oct. 2, 2000

(51) Int. Cl.[7] ..... A63H 3/44
(52) U.S. Cl. ..... 446/394; 132/53
(58) Field of Search ..... 446/394, 391; 132/53, 201

(56) References Cited

U.S. PATENT DOCUMENTS

| | | | | | |
|---|---|---|---|---|---|
| 1,090,198 | A | * | 3/1914 | Butler | 132/53 |
| 1,282,004 | A | * | 10/1918 | Shearer | 132/53 |
| 2,253,635 | A | * | 8/1941 | Mann | 446/394 |
| 2,697,304 | A | * | 12/1954 | Welch | 446/394 |
| 3,225,489 | A | * | 12/1965 | Ryan | 446/394 |
| 4,070,790 | A | * | 1/1978 | Strongin et al. | 446/394 |
| 4,623,319 | A | * | 11/1986 | Zaruba et al. | 446/320 |
| 4,674,169 | A | * | 6/1987 | Katzman et al. | 446/394 |
| 5,607,338 | A | * | 3/1997 | Landi | 446/394 |
| 6,217,407 | B1 | * | 4/2001 | Laursen | 446/394 |

FOREIGN PATENT DOCUMENTS

| | | | | |
|---|---|---|---|---|
| DE | 214342 | * | 2/1909 | |
| FR | 1195422a1 | * | 11/1959 | |
| GB | 2095549 A | * | 10/1982 | A41G/3/00 |
| JP | 63111898 A | * | 5/1988 | |
| JP | 403126479a | * | 5/1991 | |
| JP | 06304340 A | * | 11/1994 | A63H/3/44 |
| JP | 11293512 A | * | 10/1999 | A41G/3/00 |

* cited by examiner

*Primary Examiner*—Derris H. Banks
*Assistant Examiner*—Urszula M Cegielnik
(74) *Attorney, Agent, or Firm*—Robert J. Herberger

(57) ABSTRACT

A doll head and doll wig combination in which the head has a pate. The doll wig includes a thin cap that securely fits to the doll's head. The thin cap includes a substantially translucent polymer material which conforms to the shape of the head of the doll. A plurality of hairs extend from the cap. The spaced relationship of the plurality of hair filaments may show thinning, a balding pattern or thick hair. An adorned covering for the pate provides a natural skin tone which is seen through the translucent polymer material. The cap may also have a netting portion with an adjustment mechanism to fit a variety of doll head sizes.

26 Claims, 6 Drawing Sheets

DOLL HEAD WITH AN ATTACHABLE DOLL WIG AND METHOD OF MAKING THE SAME

FIELD OF THE INVENTION

This invention relates to a doll wig comprising a transparent cap wherein individual strands of hair are attached thereto without pattern. The doll wig is used on porcelain dolls to give a natural looking hair style, but it can also be used on dolls made of other materials such as plastic.

BACKGROUND OF THE INVENTION

Several people around the United States and throughout the world collect dolls. Porcelain dolls are a favorite collector's item because of the fine detail and delicate features of the figurines. Doll makers dress them with simple outfits or with very extravagant dresses made from the finest materials. Facial features are extremely important because it portrays the doll's life-like appearance. Eyes appear human-like and the eye-lashes are full and long. At a glance, one could often easily mistake a porcelain doll for a small child. In fact, many people request doll makers to construct dolls that resemble their own children, friends or relatives.

The natural appearance of the porcelain dolls can be attributed to the amount of detail used in constructing the doll's facial features, hands, fingers and hair. For example, to achieve the correct skin tone for a porcelain doll, a wash is painted on the doll's head and then baked. Several coats of wash may be used to achieve the correct skin tone and shading. The doll's head can be baked from four to five different times. At each stage more features are added, such as the eyes, eyelashes, eyebrows and the shading of the lips and cheeks. The doll's head is made of porcelain and usually comprises an opening being about 1 to 3½ inches in diameter for eye insertion. The opening, which is typically located at the crown of the porcelain doll's head, is later covered by a pate. The pate can be made of cork, cloth, styrofoam or other hard material. To finish the features of the doll's head, the hair must be attached, which generally covers the pate.

Regardless of the amount of detail made and highlighted in a porcelain doll's facial features, porcelain dolls have one significant drawback in their appearance—their hair. No matter what efforts have been made, doll wigs have never had a natural and realistic appearance. The hair does not move like natural human hair, nor can it be styled like human hair. Overall, unnatural looking hair deteriorates the quality and realistic appearance of the finished porcelain doll.

Unlike wigs or hair-replacements for humans, dolls' hair has different requirements for several reasons. First, a doll's wig needs to cover and conceal the pate at the top of the porcelain doll's head. The pate has a different color and texture, making a clear and unrealistic demarcation with the porcelain head. Second, dolls are not subject to inclimate weather. Dolls, especially collector porcelain dolls, are placed in a safe place away from the wind, rain, humidity and severe heat or cold. Third, human hair-replacements are subject to wear and tear every day through styling processes such as brushing, combing and washing. The doll's hair of the instant invention can be styled repeatedly, but the life of the doll wig is significantly prolonged because it will not be styled as frequently as human hair-replacements. Further, doll's hair may be designed to show regional baldness while human hair-replacements are designed to conceal baldness.

Also, unlike human scalps, the scalps of dolls do not need to breathe. The non-ventilated cap of the instant invention would become uncomfortable on humans because it would trap the heat and perspiration generated by a human's head. Because the scalps of doll's heads do not need to be in contact with air, perspiration and breathing problems do not exist with dolls. Because of these different requirements, and due to the smaller sizes needed for dolls, doll designers do not look to human hair-replacements to acquire doll wigs or learn new manufacturing designs and techniques.

The unnatural appearance of a doll's hair can be attributed to the archaic design and techniques used to make the doll's wig, as well as the method used to attach the doll's hair to the head. As shown in FIG. 1, one commonly used method includes creating multiple holes in a spaced relationship in the doll's head for permanently attaching large bundles of hair filaments thereto. This method is extremely impractical for porcelain dolls because the brittle porcelain has a tendency to crack and break during the drilling stage. Also, the scalp of the porcelain doll looks unnatural if the hair is parted in any fashion.

Other design techniques and methods include a doll wig having a cap made of netting, which is attached to the doll's head by glue or other conventional permanent attachment methods. As shown in FIG. 2, wigs made of netting are comprised of multiple layers of netting and cloth dyed to match the hair color. With this design, it is not preferable to show the surface of the doll's scalp, which is netting or some other cloth, by parting or brushing the hair aside. Further, the multiple layers of material cause the doll wig to look bulky, further contributing to the unrealistic appearance of the doll's hair.

FIGS. 2 and 3 show the netting type doll wigs used in the past, wherein hair is stitched in concentric-parallel circle patterns or rows. This technique is commonly known as "weft knitting." The doll wig is then finished with a center-point at the crown of the doll's head having a bundle of hair extending therefrom. Further, because the hair filaments are sewn in the concentric parallel circles from the outer parameter of the wig to the crown, the hair must be sewn extremely dense to cover the netting or cloth between adjacent rows, adding to the unnatural appearance.

The problems with these past methods of hair attachment are numerous. First, as previously stated, close examination of the scalp area of the doll's head reveals the unnatural bundles and pate as shown in FIG. 1 or the netting itself as shown in FIG. 2. Therefore, the hair needs to be very thick to hide these imperfections. Also, doll wigs usually shed because of the loose rooting techniques used to attach such large bundles of hair.

Further, the doll's hair is difficult to restyle. More specifically, the styling or position of a part in the doll's wig is fixed and is not intended to be changed by restyling. For example, if bangs were originally styled in the left direction, they cannot be styled in the right direction without showing netting. Those familiar with hair styling know that hair roots play an important role in the styling process. Hair roots control hair volume and the direction of hair growth. Most notably, styling problems are common with porcelain dolls trying to resemble younger boys. Boy dolls are rarely made because the hair style which is commonly known in the art as the "Dutch boy" look as shown in FIG. 4, is the only style typically available.

Still further, doll wigs which utilize netting have attachment problems. The netting will not allow for a close, snug fit to the doll's head. Usually, doll wigs must be permanently attached in place using glue, or other permanent attachment method. If the doll wig needs to be removed, dry glue cannot be removed from the wig or the porcelain head of the doll without damaging the same. Therefore, whenever glue is used to attach a wig to a doll, the wig typically cannot be reused on another doll. Also, attachment problems become more severe when the doll wig needs to be attached in the side burn area along the jaw line. "Popping" often occurs in these contoured areas, causing the doll wig to bulge.

Another problem doll collectors face is the lack of selection of hair styles for individual and personalized porcelain dolls. In most instances, a specific hair style and color is selected from the standard styles and sizes available. The doll designer may try to cut and shape the selected wig to more closely resemble the style he or she is trying to duplicate. However, the doll designer is confined to the selected style because of the limitations discussed above. Because of significant cost factors and considerations, the doll manufacturer does not like to deviate from the standard hair styles available to accommodate the doll collector's personal preferences.

Another styling problem occurs when a balding pattern is attempted. Obviously, if eyes are inserted through the crown of the head, a pate is needed to close the opening in the doll's head. Realistic baldness cannot be achieved because the pate needs to be covered. Without covering the pate with a wig or other covering, the pate is exposed, leaving disparities with the scalp color and contours of the doll's head. If a doll head is used that does not have a hole in the crown area, the eyes must be either painted directly on the doll's head or inserted through the more restricted hole in the neck region. As a result, the realistic appearance of these other facial features must be sacrificed.

Still another styling problem occurs when the doll maker attempts to achieve the appearance of an infant having very fine hair, which is typical with small infants. A cap made of netting cannot be used because it needs a high hair density to hide the netting. In the past and before the instant invention, a single row of hair is typically sewn to netting and then glued to the crown of the baby doll's head as shown in FIG. 4. The hair filaments are made long enough to cover the remaining area of the doll's head. More specifically, the hair filaments lay on the doll's head. If the hair filaments are pushed aside, the doll's scalp is simply exposed and the unrealistic rooting technique being used is revealed.

In summation, there is nothing currently in the art capable of giving doll wigs a more natural human-like appearance. The purpose of this invention is to provide a doll hair-piece that is versatile, restylable and gives a natural, realistic and life-like appearance.

SUMMARY OF THE INVENTION

The present invention solves the aforementioned problems by providing a doll head with an attachable wig. The doll wig comprises a thin cap made of a translucent, polymer resin material, such as polyurethane, silicone, resin or polypropylene. The entire thin cap or select isolated areas can be made of the polymer material. In this invention, hairs are attached to the polymer portion of the thin cap individually and not in bundles or clusters. This construction helps to give the hair a more life-like appearance. More specifically, with the exception of a styrofoam pate, an acrylic paint is painted directly to the pate and dried to match the skin tone of the doll's head. With styrofoam, a primer is applied first in the manner described in more detail with the preferred embodiment. When the wig is placed on the doll, the skin tone of the doll's head can be seen through the polymer cap, giving the hair style a natural appearance. Parts in the hair look natural because the hair appears as appendages of the scalp and the color of the scalp is the same as the doll's skin tone.

With this invention, doll wigs can be custom made to suit a doll collector's preference, and the hair can be easily restyled. Another benefit concerns friction between the polymer material and the porcelain doll head. With this invention, friction is much greater than netting or cloth. Higher friction between the two surfaces provides a snugger fit to the porcelain so less permanent adhesion techniques are required to secure the doll wig to the doll's head. Further, since the doll wig in this invention provides for a snugger fit, there appears a more realistic transition between the face of the doll and its scalp.

Accordingly, it is an object of the present invention to provide doll hair for porcelain dolls that are life-like.

Another object of the present invention is to provide doll hair wherein the cap of the doll wig is substantially transparent such that the doll's skin tone can be seen through the cap.

Another object of the present invention is to provide a doll wig that is removable and reusable.

Still, another object of the present invention is to provide doll hair where the hairs are individually attached to the cap of the doll wig.

Yet, another object of the present invention is to provide a doll wig which fits snugly to a doll's head and prevents "popping" around contours of the doll's head, such as the side-burn and jaw line locations.

Another object of the present invention is to provide a doll wig with more adjustability in size than typical doll wigs.

Further, another object of the present invention is to provide a doll wig wherein the hair style can be easily changed through conventional styling methods.

Another object of the present invention is to provide doll hair that provides hair style versatility to satisfy customers' personal preferences.

Still yet, another object of the present invention is to provide doll hair that is capable of underlooping so that the edge of the wig is not easily perceptible, providing doll hair that has a more natural transition from the doll's face to the wig.

Still, another object and embodiment of the present invention is to provide doll hair that uses a lesser amount of hair to construct the doll wig.

Still yet, another object of the present invention is to provide doll hair which permits more versatile hair styles or hair lines, including but not limited to partial baldness in places.

Further, another object of the present invention is to provide doll hair for a porcelain doll with a child-like resemblance having thin hair.

Yet another object of the present invention is to provide a doll wig that doesn't shed.

Another object of the present invention is to provide doll hair which is economically affordable in view of all the advantages it has to offer.

Further, an object of the present invention is to provide another embodiment of the doll wig where only a portion of the cap is made of the transparent polymer.

Other objects and features of the present invention will be obvious to those skilled in the art upon contemplation of the disclosure herein in connection with the accompanying drawings. It is to be understood, however, that the drawings are designed for the purpose of illustration only and not as a definition of the limits of the instant invention, for which reference should be made to the claims appended hereto.

BRIEF DESCRIPTION OF DRAWINGS

The figures listed below have been selected to illustrate a preferred embodiment of the present invention. These figures along with the accompanying description are sufficient for those skilled in the art to practice the invention as claimed.

DETAILED DESCRIPTION OF THE PREFERRED EMBODIMENT

Figure 5:
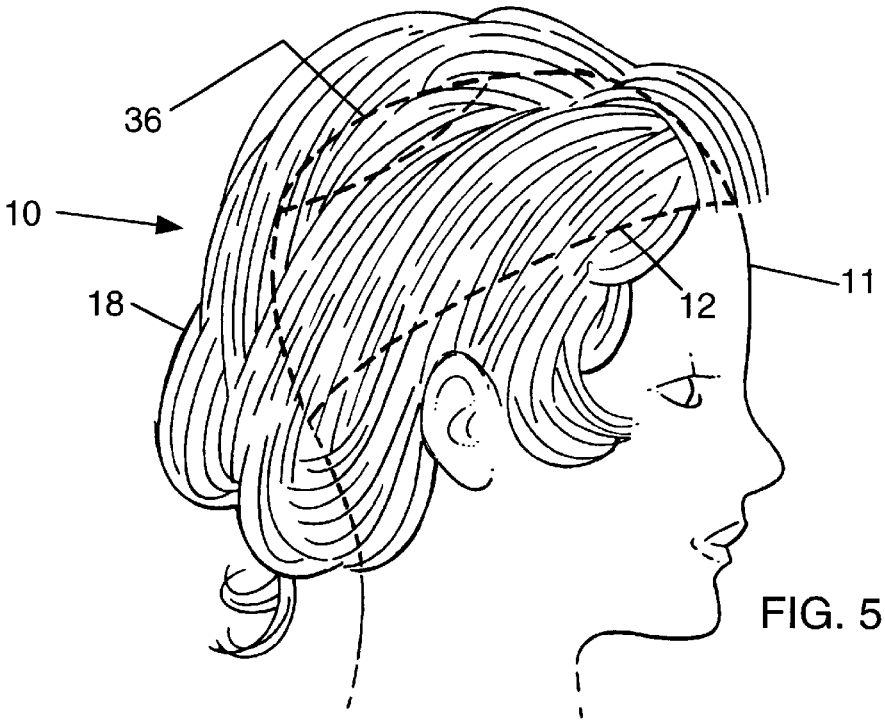
FIG. 5 is a side view of the present invention having a thin polymer cap.
Figure 11:
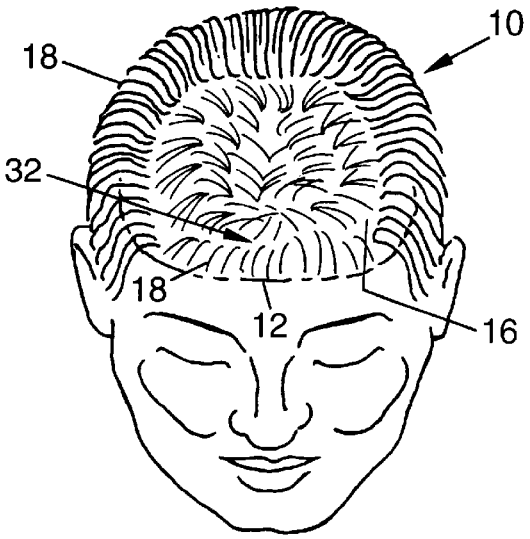
FIG. 11 is a perspective view showing yet another embodiment of a doll wig having partial balding on the forehead.
Figure 13:
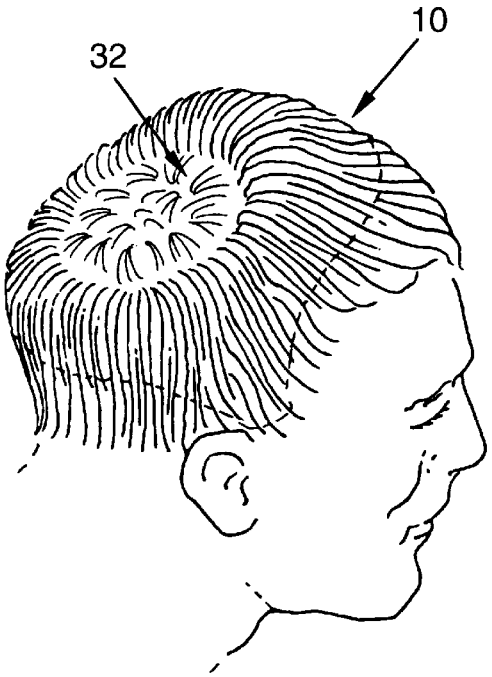
FIG. 13 is a perspective view showing another embodiment with balding at the crown of the doll's head.

Turning now to FIG. 5, a first embodiment of a doll wig 10 for a doll head 11 is shown where the doll head 11 has a pate 36 adorned with a natural skin tone. The doll wig 10 comprises a thin cap 12 that securely fits to the doll's head 11 and is made of a substantially translucent polymer material 16 creating a skin like appearance. The doll wig 10 also comprises a plurality of hair filaments 18 attached to the cap 12. The hair filaments may be synthetic, actual human hair or a combination of both. As shown in FIGS. 11 and 13, the hair filaments 18 can be attached to the cap 12 in a thinning spaced relationship to show infant hair styles or adult balding. The thin cap 12 attaches to the doll head 11 such that the pate 36 is covered by the thin cap 12, and the skin tone covering the pate 36 can be seen through the substantially translucent polymer material 16.

Generally, translucent polymer materials permit light to pass through, but the light is diffused so that objects on the opposite side are not clearly visible, such as with frosted glass. Transparent materials are slightly different than translucent materials. Transparent materials allow light to pass through so that an object on the opposite side can be clearly seen, such as a clear window. In the present invention, either translucent or transparent polymer material 16 can be used, but a flat, translucent polymer material having a matte outer surface, such as that used and described in U.S. Pat. No. 3,848,612, is usually preferred.

Figure 7:
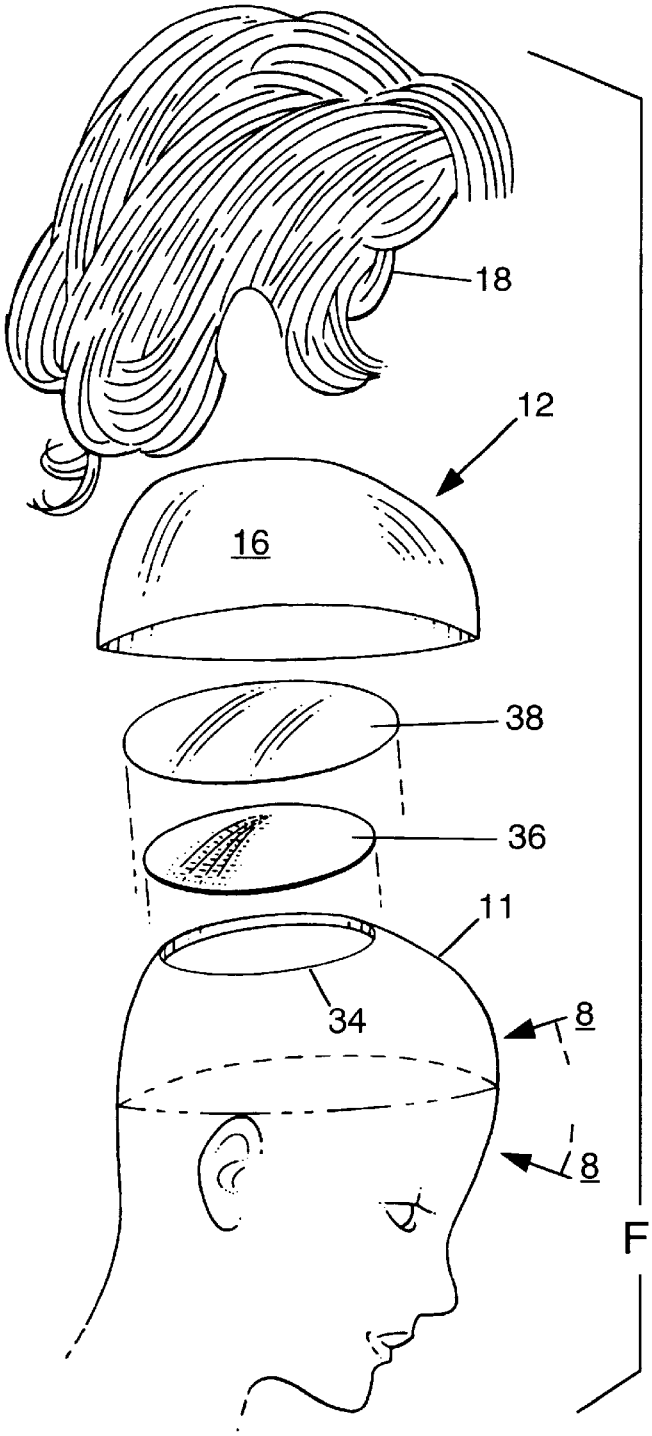
FIG. 7 is an exploded view of the present invention showing individual hair filament attachment to the thin polymer cap.

To achieve the natural skin tone adorning the doll head 11 and top of the pate 36, various techniques and steps may be followed. An adorned covering 38 over the pate 36 may be made of a thin, opaque foil having an outer surface with a skin tone color that substantially matches and blends with the skin tone of the dolls head. The adorned covering 38 is positioned between the pate 36, which is used to conceal the opening 34 through the doll head 11, and the underside of the thin cap 12 as shown in FIG. 7. As an alternative, the adorned covering 38 may be a paint made of acrylic, oil or polyurethane. Preferably, two coats of paint are applied to the top of the pate 36 to cover its texture, which is typically a gauze-like material, and give a skin-like texture. Also, the paint is used to smoothly transition the pate's outer edge with the doll's head. If the pate 36 is made of styrofoam, a primer typically used on canvas or fiber board for oil or acrylic paint must be applied before covering with paint as described above. Of course, the color of the acrylic, oil or polyurethane paint is selected to match or otherwise complement the skin tone of the doll's head 11.

The process of manufacturing the thin cap 12 made of a translucent polymer, and the attachment of the plurality of hair filaments 18 to the same, is similar to the method used for making hair-replacements for humans, such as that described in U.S. Pat. No. 3,848,612. The translucent polymer material can be made of polyester, polyurethane or silicone resin, or other similar material. In one embodiment of this invention, the thin cap 12 is essentially a layer of translucent polymer material 16 contoured to conform with and directly contact the doll head 11. To blend with the skin tone of the scalp 32 and pate 36, the polymer material 16 may be tinted or dyed to acquire a flesh-like color with a matte outer surface.

The size of the doll wig 10 typically varies between approximately 5 inches to 17 inches. The doll maker determines the size by measuring around the forehead, behind the ears and around the nape of the neck.

Unlike conventional doll wigs, the translucent polymer material 16 of the cap 12 of the present invention provides a snug fit to the porcelain surface of the doll head 11. Friction between the translucent polymer material 16 and the doll head 11, which is typically made of porcelain, is much greater than netting or cloth conventionally used. As a result, higher friction between the two surfaces in this invention provides a snugger fit so less permanent adhesion techniques are required to secure the doll wig 10 to the doll's head 11.

Figure 8:
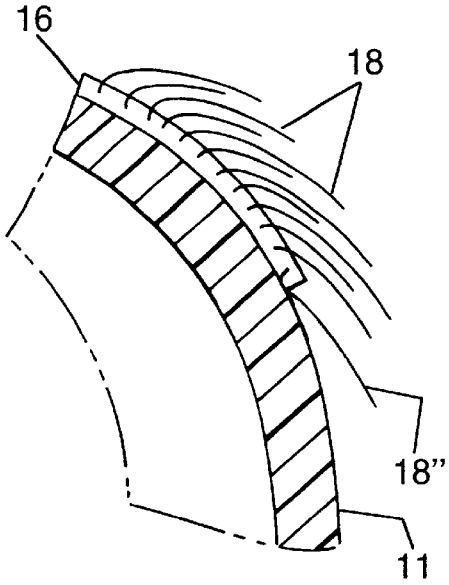
FIG. 8 is an enlarged partial cross sectional view on lines 8—8 of FIG. 7.
Figure 14:
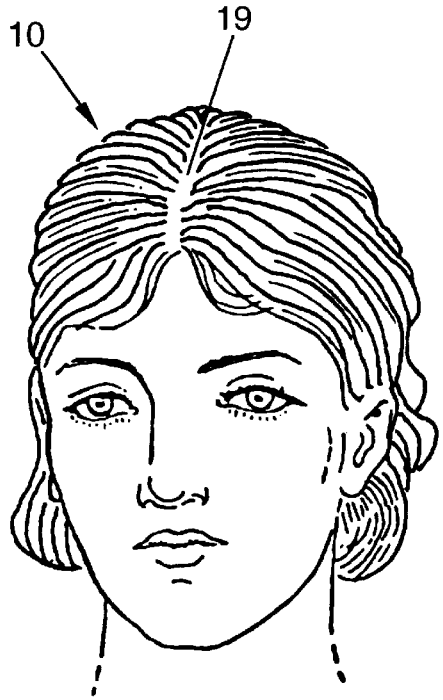
FIG. 14 shows a perspective view of a doll having a doll wig of the instant invention with a part.

The plurality of hair filaments 18 are attached individually to or embedded in the thin cap 12. As a result, a lesser amount of hair filaments 18 is required to manufacture the doll wig 10 in comparison to traditional doll wigs. The plurality of hair filaments 18 are also stylable to show a part 19 in any selected location of the thin cap 12 as shown in FIG. 14. Further, the plurality of hair filaments 18" may be attached about the edge line 14 of the underside 17 of the thin cap 12. This process is commonly referred to as underlooping and shown in FIGS. 8 and 12. The underlooped hair filaments 18" help to conceal the edge line 14 of the thin cap 12, thereby providing a more realistic appearance.

Figure 12:
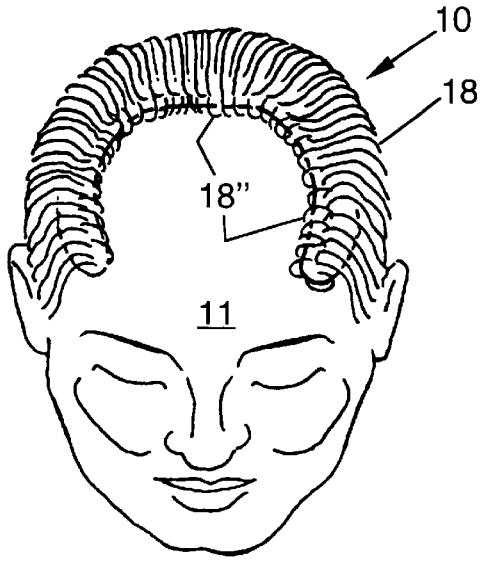
FIG. 12 is a perspective view showing still another alternate configuration of a doll wig having partial balding wherein the cap outlines the balding and underlooping is seen to conceal the transition from the bare scalp to the wig of the porcelain doll.

Further, with the instant invention, the density of the hair filaments 18 is easily controlled since each hair is individually attached to the thin cap 12. To style a doll wig 10 for an infant with thin hair or an adult with balding, a low hair density is used to create different appearances, some of which are shown in FIGS. 11–13. More specifically, a doll wig 10 with a thinning appearance shows portions of the scalp 32 across the entire head or in select areas, such as in the forehead area. Varying hair densities may be used to achieve a thicker appearance in some areas in the doll wig 10 and balding in others such as at the crown of the doll's head 11, more typically seen with adult males.

Figure 6:
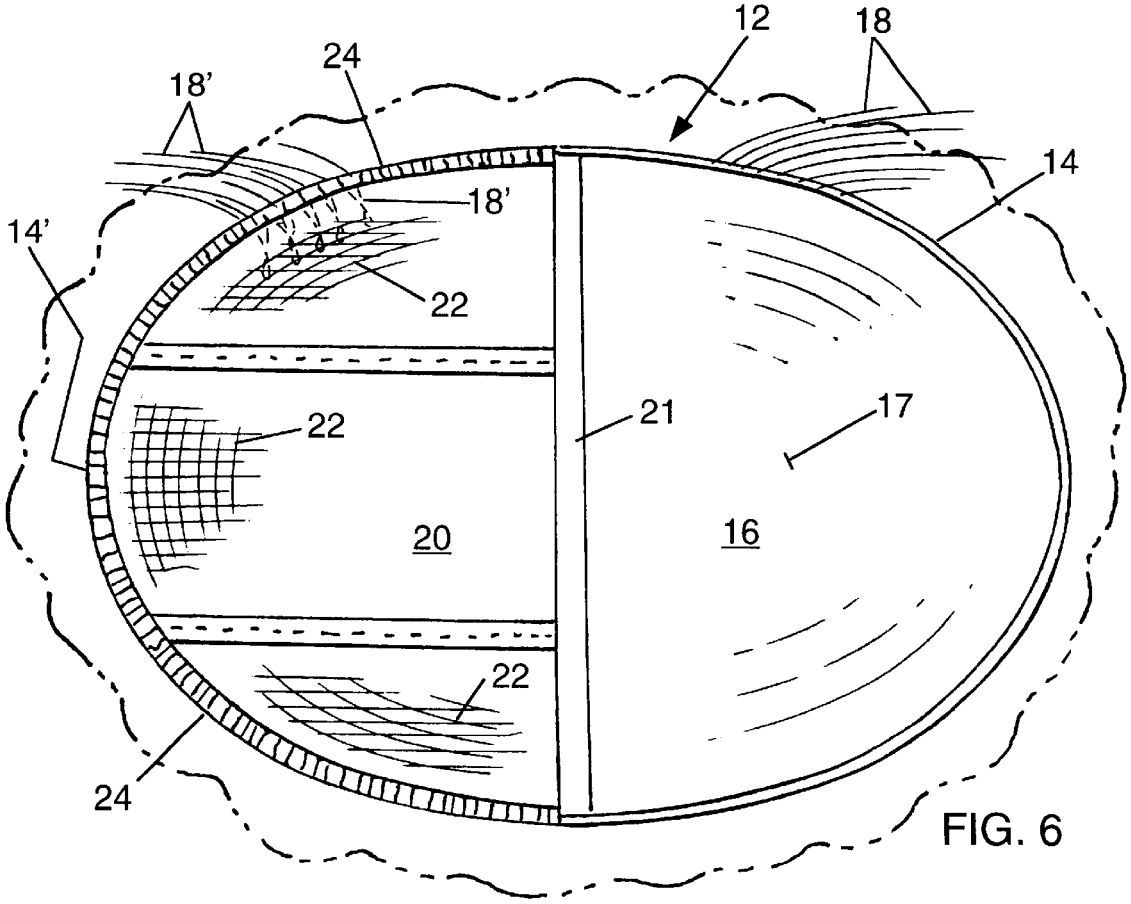
FIG. 6 is a bottom view of an alternate configuration of the thin cap having the polymer portion selectively attached to a fine mesh.
Figure 9:
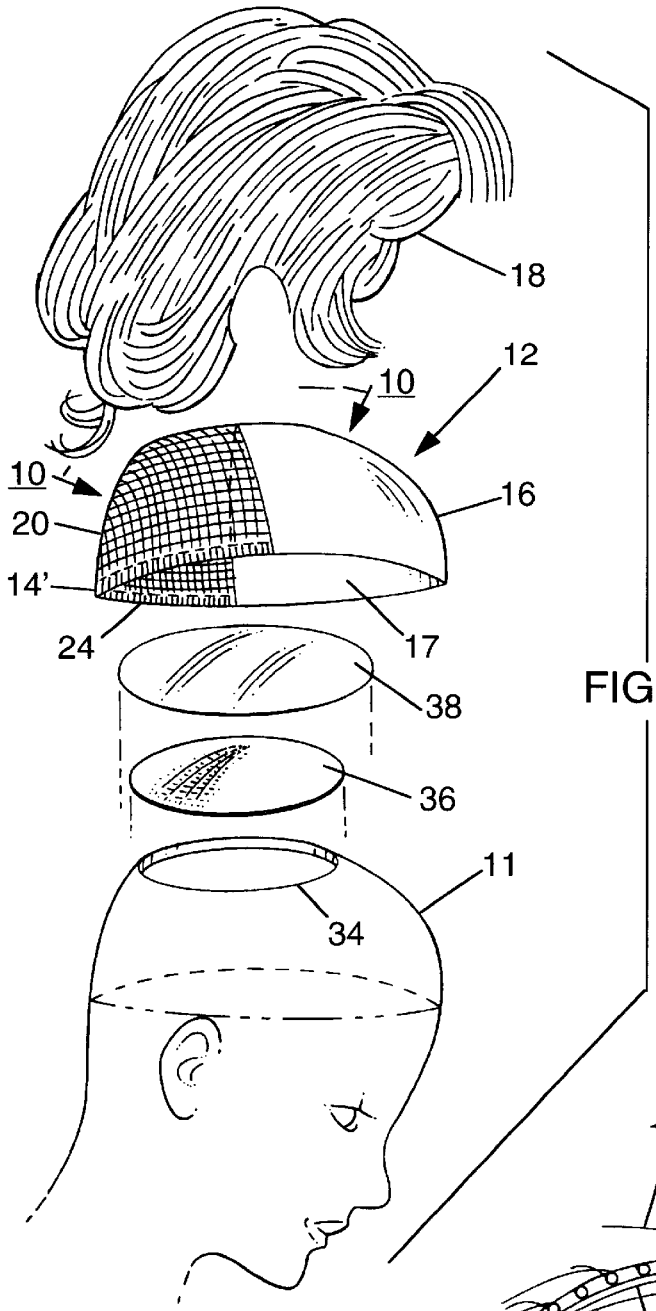
FIG. 9 is an exploded view of an alternate configuration showing individual hair filaments attached to the cap having the polymer portion selectively attached to a fine mesh with an adjustment mechanism therein.
Figure 10:
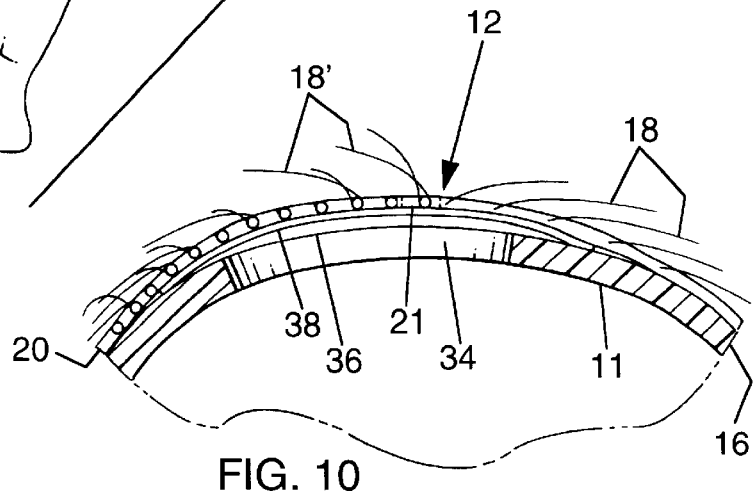
FIG. 10 is an enlarged partial cross-sectional view on lines 10—10 of FIG. 9.

FIGS. 6, 9 and 10 show a second embodiment of the present invention, where the thin cap 12 comprises the polymer material 16 and a flesh-colored netting portion 20. The netting portion 20 is elastic and has a very fine mesh 22 attached by glue or other permanent bonding technique to the polymer material 16 to form the thin cap 12. The netting portion 20 is overlapped and attached to the polymer material at seam 21. The optimum mesh size is approximately 44×36 openings per square inch, which indicates about 44 openings per inch across the head (traversing from ear to ear) and about 36 openings per inch in its perpendicular direction (traversing from the crown to the back of the neck); but, of course the mesh size increases when the netting portion 20 is elastically stretched to conform and securely fit the cap to the doll's head 11. Also, it is important to note that the skin tone of the scalp 32 shows through the mesh openings when it is stretched and fitted over the doll's head 11 in the preferred embodiment, creating a more natural and realistic appearance.

Figure 1:
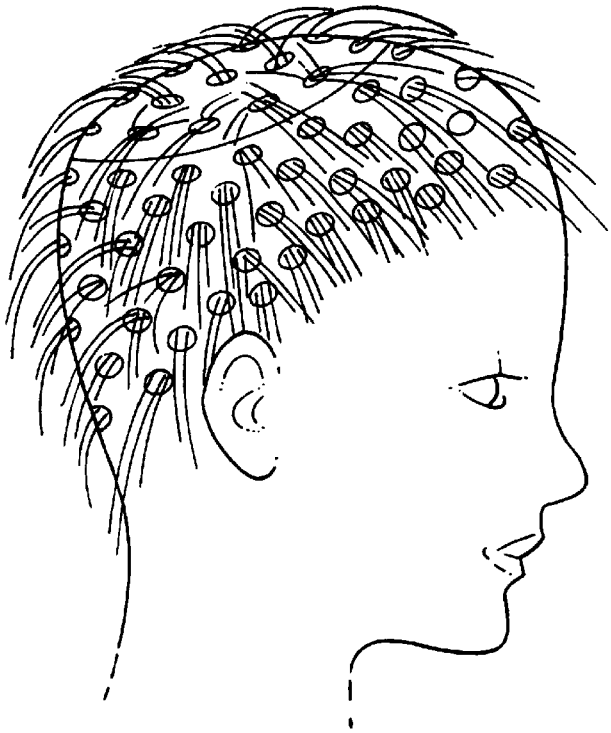
FIG. 1 PRIOR ART
FIG. 1 is a side view of a doll's hair in the prior art where hair bundles are rooted directly to the doll's head through drilled holes.
Figure 2:
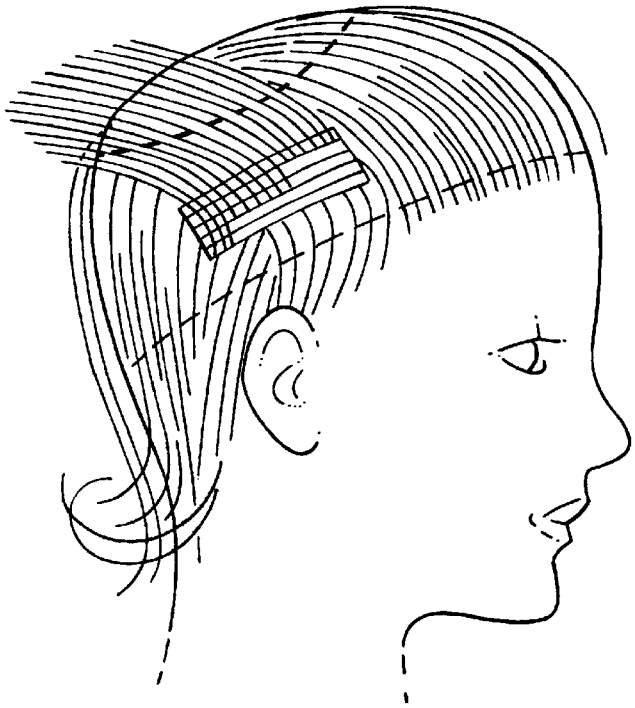
FIG. 2 PRIOR ART
FIG. 2 shows a side view of a doll wig known in the prior art made by weft knitting and shows bare portions between the concentric-circular patterns of hair sewn to the wig cap made of fabric.
Figure 3:
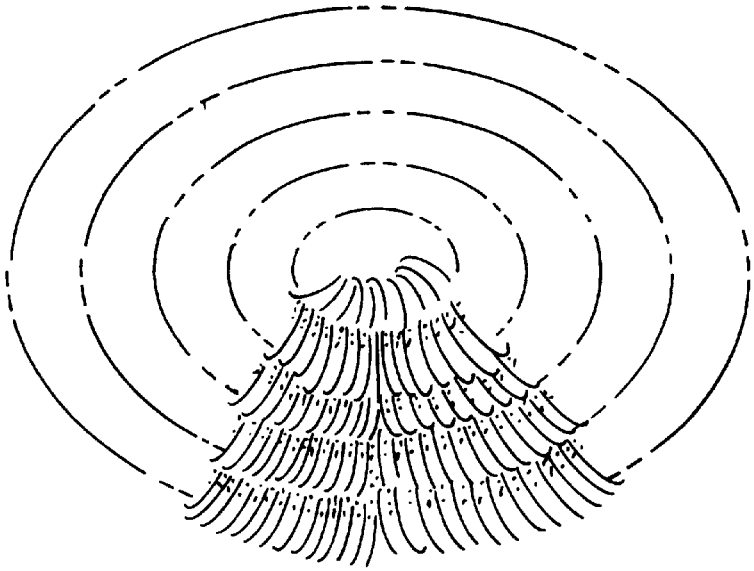
FIG. 3 PRIOR ART
FIG. 3 is a top view of a doll wig known in the prior art and made by weft knitting, showing in more detail the circular rows of hair used in the weft knitting technique.
Figure 4:
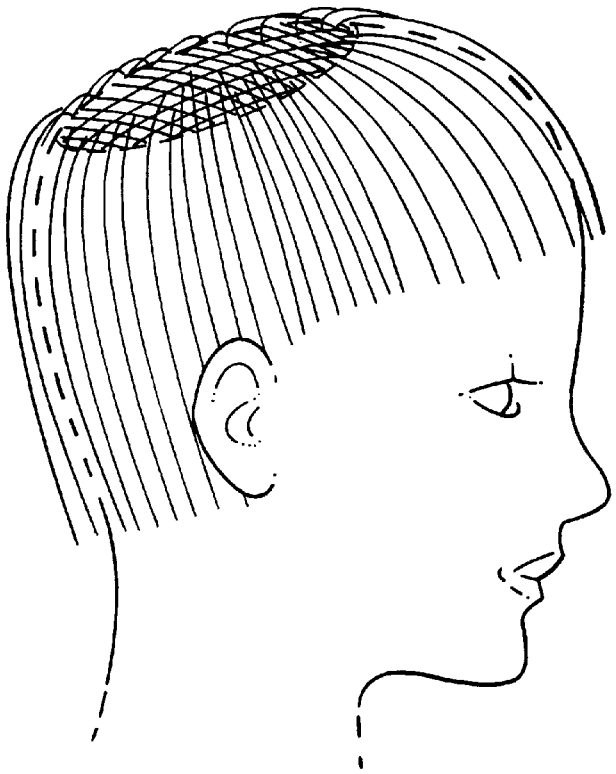
FIG. 4 PRIOR ART
FIG. 4 is a side view of a typical doll wig used in the prior art for a young child.

The plurality of hair filaments 18' knotted to the netting portion 20 through the mesh 22 is done in very small bundles. As shown in FIG. 10, the small bundles comprise between one to three hair filaments 18', preferably, hand looped and tied around a corresponding mesh fiber using a needle. Each filament 18' looped and tied to a mesh fiber gives the appearance that there it is two separate hairs. It is important to notice that the filaments 18' per bundle in the instant invention are far fewer than the number of hairs per bundle previously described and currently being used with typical doll wigs shown in FIG. 1. Also with the fine mesh 22 of the instant invention, the spaced relationship of the plurality of hair filaments 18' can be varied to match the spaced relationship of the plurality of hair filaments 18 embedded in the translucent polymer material 16, or it can be made thicker to contrast with thinning hair or a balding pattern. Although the fine mesh 22 of the netting portion 20 is not as visually apparent as the netting used with conventional doll wigs when styling and parting the plurality of hair filaments 18', in the preferred embodiment the fine mesh 22 should be located only in areas of the doll wig 10 where the plurality of hair filaments 18' are more dense and where there is no hair part 19. Although, the netting portion 20 is somewhat obscured when the plurality of hair filaments 18' is moved or restyled, it is preferable to use translucent polymer material 16 for the thinning areas, parts and across the hairline of the forehead.

The netting portion 20 used on the thin cap 12 can range anywhere from ten percent to fifty percent of the total surface area of the thin cap 12. Of course, any amount of netting could be used to fit the customer's needs, but this range is preferable. Continuing to view FIG. 9, the netting portion 20 of the thin cap 12 may also include an adjustment mechanism 24. In this second embodiment, the back edge line 14' of the netting portion 20 of the of the thin cap 12 covering the back of the doll's head 11 comprises a strip of elastic, which stretches to adjustably and snugly fit different doll head sizes. Although the elastic strip is preferable, any other type of adjustment mechanism 24 could be used, such as, but not limited to, a draw-string, a velcro strap or snap. Besides providing more flexibility for sizing, using the netting portion 20 with adjustment mechanism 24 lowers the overall cost of the doll wig 10 of this invention. By contrast, when the translucent or transparent polymer material 16 comprises the entire thin cap 12 as shown in FIG. 7, each doll wig 10 has some adjustability, but it is preferable that each wig 10 be custom sized and fit to the particular doll head 11.

As previously discussed, a major benefit of the instant invention is that it gives the doll marker the ability to design porcelain dolls having different shapes of balding or a more natural part which was never before available. It is important, therefore, to describe these embodiments with more detail. As previously stated, it is preferable that the translucent polymer material 16 is used in those areas of the thin cap 12 so that the natural flesh color of the scalp 32 and/or adorned covering 38 shows therethrough. As shown in FIGS. 11, 13 and 14, the plurality of hair filaments 18 are embedded in the translucent polymer material 16 of the thin cap 12 in a balding pattern or to show a part. Alternatively, the thin cap 12 may be molded or cut to form the balding pattern which is best seen in FIG. 12. To effectively attach this thin cap 12, an adhesive, such as two sided tape or glue, may be required to prevent the doll wig 10 from slipping off the doll's head 11.

The method for making a doll head 11 with an attachable wig 10 comprises the steps of preparing a doll head 11 to have a selected skin tone on the scalp 32. Applying an adorned covering 38 such as a matching flesh color foil or paint over the top of the pate 36 and securing the thin cap 12 with the translucent polymer material 16 alone, or in select combination with the netting 20 as previously discussed, to the prepared doll head 1 1. Hair filaments 18, 18' and 18" are selectively, and preferably, individually secured to the thin cap 12 to allow styling so that the skin tone of the scalp 32 and/or adorned covering 38 of the pate 36 can be seen through the translucent material 16. An adhesive may also be placed on the underside 17 of the thin cap 12 before securing the cap 12 to the finished doll head 11.

Although the present invention has been described in considerable detail with reference to certain preferred versions thereof, other versions are possible. Therefore, the spirit and scope of the appended claims should not be limited to the description of the preferred versions contained herein.

What is claimed is:

1. In combination, a doll wig for a doll's head having a pate, said doll wig comprising a thin cap that securely fits to said doll's head and being made of a substantially translucent polymer material having a non-reflective outer surface, a plurality of hair filaments attached to said cap in a thinning spaced relationship, said thin cap attaching to said doll head such that said pate is covered by said thin cap, and an adorned covering for said pate having a skin tone that substantially matches the skin tone of the dolls head, whereby the adorned covering can be seen through said translucent polymer material.

2. The combination according to claim 1, wherein said plurality of hair filaments attached to said cap in a thinning spaced relationship shows a partial balding pattern.

3. The combination according to claim 2, wherein said thin cap further comprises a netting portion having a mesh, the netting being attached to the substantially translucent polymer material.

4. The combination according to claim 3, wherein said netting portion comprises between 10% and 50% of the surface area of said thin cap.

5. The combination according to claim 3, wherein said thin cap is a single layer material, and said adorned covering for said pate is positioned over the pate and under the thin cap.

6. The combination according to claim 3, wherein said plurality of hair filaments are individually embedded to said substantially translucent polymer material of said thin cap.

7. The combination according to claim 3, wherein said thin cap has an edge line and an underside, said plurality of hair filaments being attached to said underside about said cap edge line are underlooped.

8. The combination according to claim 3, wherein said thin cap has an adjustment mechanism to vary the size of said thin cap.

9. A doll wig for a doll's head having a pate being adorned with a covering having a skin tone that substantially matches and blends with the skin tone of the doll's head, said doll wig comprising:

a thin cap that securely fits to said doll's head and being made of a translucent polymer material; and a plurality of hair filaments attached to said cap in a high density spaced relationship, said plurality of hair filaments being stylable to show a part in a selected location of said thin cap, said thin cap attaching to said doll head such that said pate is covered by said thin cap, and said skin tone of said pate covering can be seen through said part.

10. The doll wig of claim 9, wherein said thin cap further comprises a netting portion having a mesh, the netting being attached to the translucent polymer material.

11. The doll wig of claim 10, wherein said netting portion comprises less than 50% of the surface area of said thin cap.

12. The doll wig of claim 9, wherein said thin cap is a single layer material, and said adorned covering for said pate adheres over the pate and is positioned under the thin cap.

13. The doll wig of claim 9, wherein said plurality of hair filaments are individually embedded to said translucent polymer material of said thin cap.

14. The doll wig of claim 9, wherein said thin cap has an edge line and an underside, said plurality of hair filaments being attached to said underside about said thin cap edge line are underlooped.

15. The doll wig of claim 9, wherein said thin cap has an adjustment mechanism to vary the size of said thin cap.

16. A doll, comprising:

an attachable wig having a cap with a plurality of hair filaments attached thereto, said cap comprising a translucent polymer material and the cap conforms to the shape of the doll's head, said doll head having a skin tone, a pate having a skin tone color that substantially blends with the skin tone of the doll's head, said skin tone color of the pate and the skin tone of the doll's head showing through said translucent polymer material of said cap.

17. The doll of claim 16, wherein said plurality of hair filaments of said doll wig is attached in a balding pattern.

18. The doll of claim 16, wherein said transparent polymer cap of said doll wig is shaped in a balding pattern.

19. The doll of claim 16, wherein said plurality of hair filaments of the doll wig are underlooped about an edge of said cap.

20. The doll of claim 16, wherein the cap further comprises a netting portion with an adjustment mechanism to accommodate different doll head sizes.

21. A method for making a doll head with a scalp and an attachable wig, comprising the steps of:

adorning the doll head with a covering to have a selected skin tone on the scalp;

securing a wig to the adorned doll head, said wig comprising a cap having a polymer material, said cap having a plurality of hair filaments attached thereto in a spaced relationship with a portion of said plurality of hair filaments being underlooped about an edge of said cap, a net portion attached to said polymer material, said net portion having a mesh and an adjustment mechanism; and styling said plurality of hair filaments so that the skin tone on the scalp can be seen through the polymer material of the cap.

22. The method of claim 21, further comprising the step of placing an adhesive on the underside of said cap before securing the wig to the adorned doll head.

23. The method of claim 21, wherein said plurality of hair filaments are attached to said cap in a thinning spaced relationship.

24. The method of claim 21, wherein said plurality of hair filaments are attached to said cap in a high density spaced relationship.

25. The method of claim 23, wherein said plurality of hair filaments attached to said cap in the thinning spaced relationship show a balding pattern.

26. The method of claim 25, wherein said plurality of hair filaments are styled to show a part such that the skin tone of the scalp can be seen through said polymer material.

* * * * *